US005377967A

United States Patent [19]

Eberle

[11] Patent Number: 5,377,967

[45] Date of Patent: Jan. 3, 1995

[54] METHOD AND APPARATUS FOR LIFTING PRINTING PRODUCTS OFF A STACK

[75] Inventor: Jürg Eberle, Hinwil, Switzerland

[73] Assignee: Ferag AG, Zurich, Switzerland

[21] Appl. No.: 7,536

[22] Filed: Jan. 22, 1993

[30] Foreign Application Priority Data

Jan. 30, 1992 [CH] Switzerland ..... 00274/92

[51] Int. Cl.[6] ..... B65H 5/08

[52] U.S. Cl. ..... 271/11; 271/107; 271/90

[58] Field of Search ..... 271/94, 95, 96, 107, 271/11, 90

[56] References Cited

U.S. PATENT DOCUMENTS

| | | | |
|---|---|---|---|
| 4,127,262 | 11/1978 | Eberle et al. . | |
| 4,589,649 | 5/1986 | Prescher | 271/107 |
| 4,657,236 | 4/1987 | Hirakawa et al. . | |
| 5,094,439 | 3/1992 | Renner et al. . | |
| 5,127,645 | 7/1992 | Torisawa | 271/11 |

FOREIGN PATENT DOCUMENTS

| | | | |
|---|---|---|---|
| 0488316 | 6/1992 | European Pat. Off. . | |
| 2233262 | 1/1975 | France . | |
| 2539339 | 3/1977 | Germany . | |
| 4009417 | 11/1990 | Germany . | |
| 40295520 | 3/1992 | Germany . | |
| 4033870 | 4/1992 | Germany . | |
| 679221 | 1/1992 | Switzerland . | |
| 271509 | 9/1927 | United Kingdom | 271/107 |
| 2060579 | 5/1981 | United Kingdom . | |

*Primary Examiner*—H. Grant Skaggs

[57] ABSTRACT

By means of a lever mechanism a suction head periodically connectable to a vacuum source is moved along a closed orbit between a pick-up point and a delivery point. At the pick-up point the suction head grips the respectively uppermost product in a stack and brings it to the delivery point, at which the product is released. The drive shaft of the lever mechanism is driven by a drive device at a varying speed in such a manner that the suction head is moved along its movement path at a speed which is minimal in the region of the pick-up point during the carrying along of a product immediately after it has been gripped, and then increases. Faultless gripping of the printing products is thereby achieved and the next printing product is prevented from being carried off with it by the action of suction.

The drive device may be an intermediate or superimposition transmission unit which is driven at constant speed of rotation on by a drive motor and which for example is in the form of a rotating slider crank.

13 Claims, 4 Drawing Sheets

METHOD AND APPARATUS FOR LIFTING PRINTING PRODUCTS OFF A STACK

BACKGROUND OF THE INVENTION

The present invention relates to a method and an apparatus for lifting printing products off a stack.

From DEC-C-27 32 591 (and the corresponding U.S. Pat. No. 4,127,262) an apparatus for taking apart a stack of printing products of this kind is know, in which the suction head is moved by a drive mechanism along a closed orbit, the shape of which resembles a hypocycloid. At the top reversal point on this movement path the suction head grips a corner of the printing product at the bottom of the stack at a given moment and carries this corner to the next, bottom reversal point. The drive mechanism, which comprises a planetary gear unit connected to a constant-speed drive motor, is intended primarily for moving the suction head along the aforesaid movement path having a determined shape. Although the speed of the suction head varies during its movement along this path, nevertheless the speed variations which occur are dependent on the design of the drive mechanism and therefore on the shape of the movement path.

SUMMARY OF THE INVENTION

The problem underlying the present invention is that of providing a method and an apparatus of the type indicated above, which make it possible to vary within wide limits, and independently of the shape of the movement path, the speed of the suction head during its movement along its path.

According to the invention this problem is solved by a method and apparatus for lifting printing products off of a stack with at least one suction head. The head is periodically connected to a vacuum source and is moved by means of a drive mechanism and drive motor along a path of movement from a pick-up point at which one product is gripped at a time to a delivery point at which the gripped product is released. The head then moves back to the pick-up point for another product.

The drive mechanism is driven at a varying speed and in such a manner that the suction head is moved along its path of movement at a speed which is minimal in the region of the pick-up point after the product has been gripped and then increases.

The solution according to the invention is in fact based on the concept of superimposing on the speed of movement of the suction head, resulting from the action of the drive mechanism, a speed produced by means which are separate from the drive mechanism. With a given shape of the movement path determined by the drive mechanism, it is thus possible, without acting on said movement path, to vary the speed of movement of the suction head, particularly in such a manner that after a printing product has been gripped the speed of the suction head is minimal during the carrying of said product immediately thereafter. It is thus possible to prevent the next product from being carried off with it by the action of suction when the printing product is lifted off the stack.

Preferred further developments of the subject of that invention are defined further below.

BRIEF DESCRIPTION OF THE DRAWINGS

Exemplary embodiments of the subject of the invention are further explained below with reference to the purely schematic drawings, in which.

DESCRIPTION OF THE PREFERRED EMBODIMENTS

Figure 1:
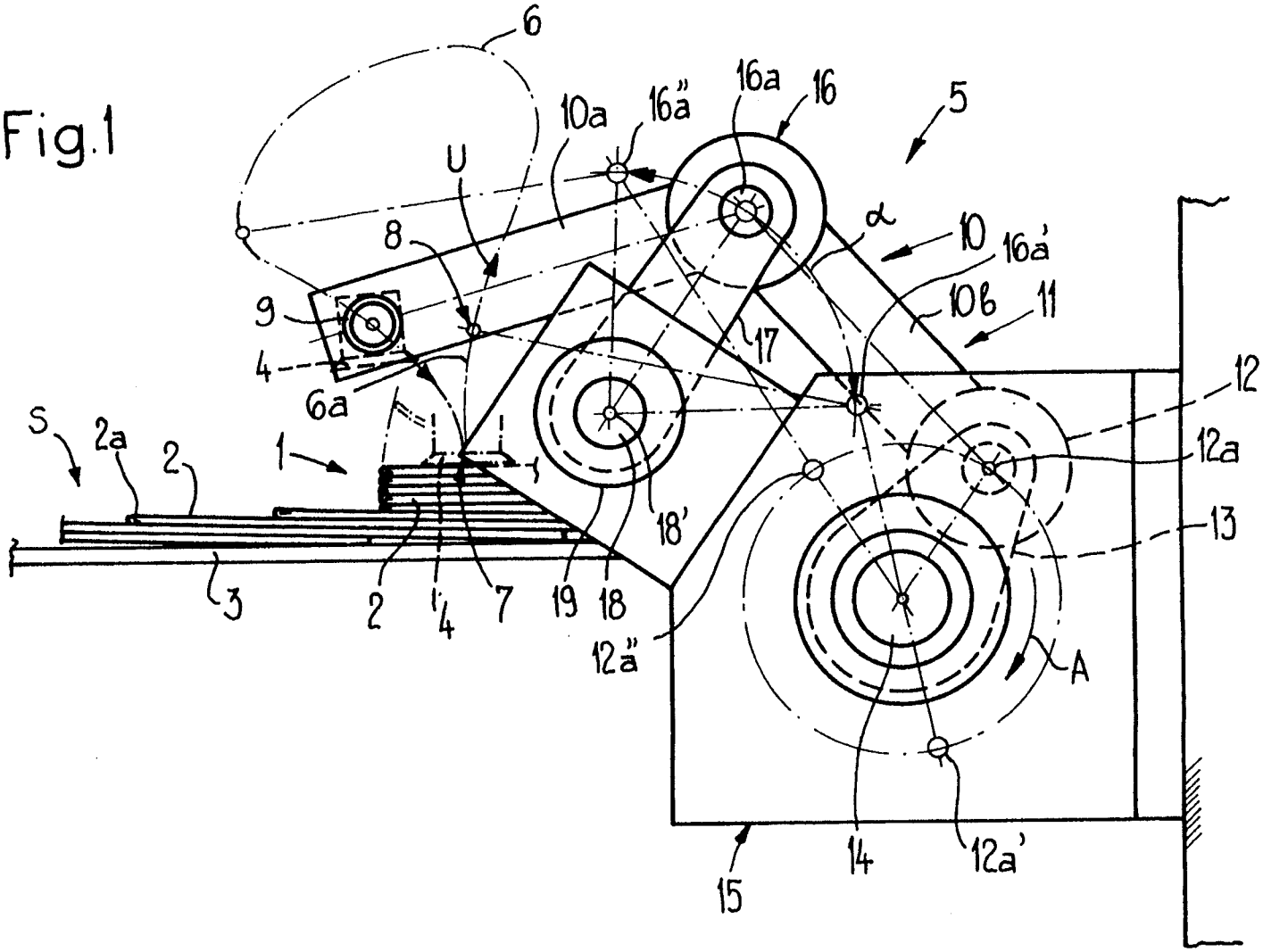
FIG. 1 is a side view of a first embodiment of an apparatus for lifting printing products off a stack.
Figure 2:
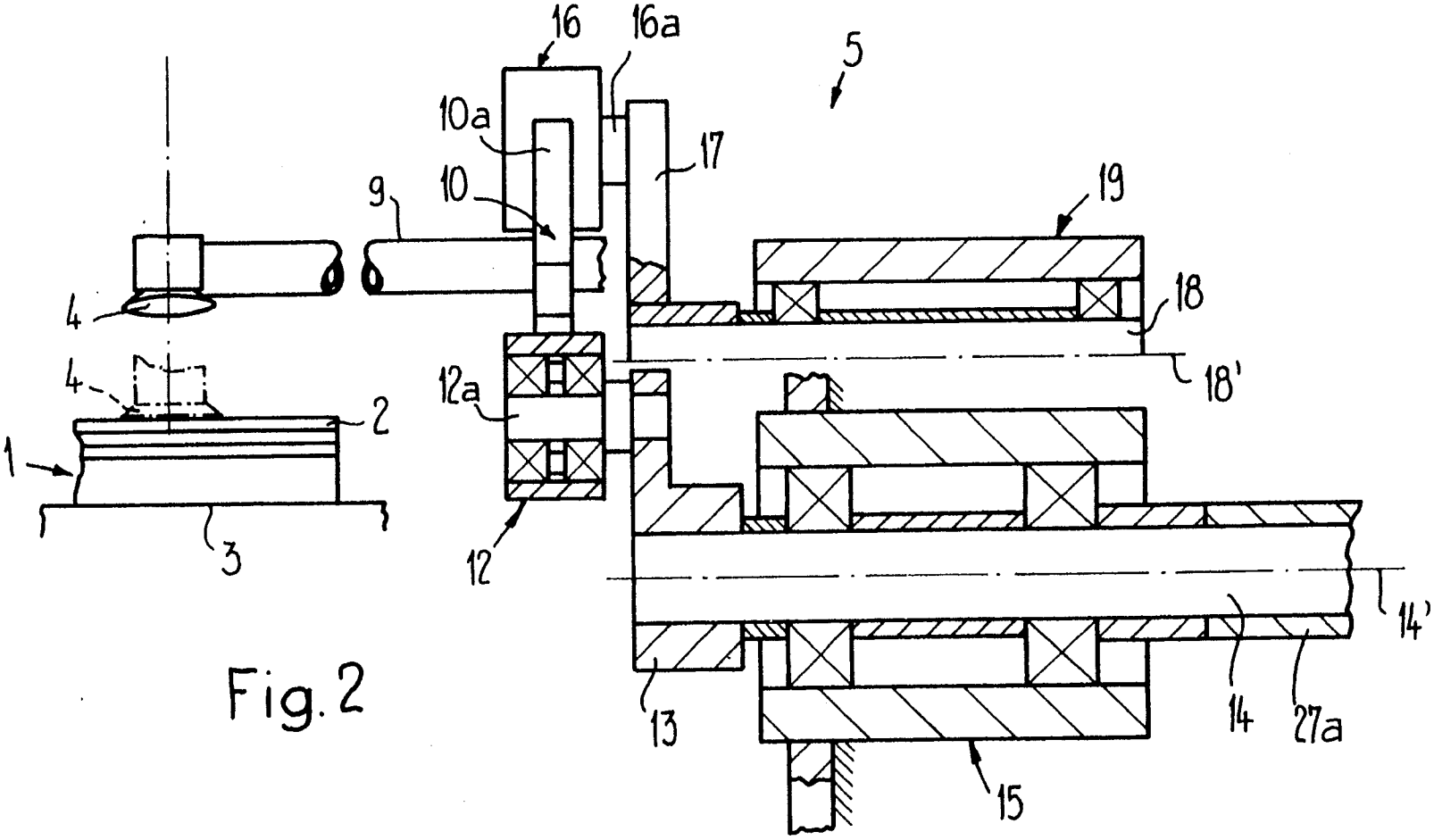
FIG. 2 is a cross-section of the drive mechanism of the apparatus shown in FIG. 1.

In FIGS. 1 and 2 the reference 1 designates a stack which is formed by folded printing products 2. The latter are fed by a feed conveyor 3 in an imbricated formation S, in which each printing product 2 lies on the following printing product. This means that the following edge 2*a*, which in the present embodiment is the fold edge, lies at the top in the imbricated formation S. The printing products 2 are pushed into the stack from below, as explained more fully in U.S. patent application Ser. No. 07/997,886, filed Dec. 29, 1992 entitled PROCESS AND APPARATUS FOR DELIVERING PREFERABLY FOLDED PRINTING PRODUCTS TO A FURTHER PROCESSING POINT.

For the purpose of lifting off from the stack 1 the printing product 2 which is uppermost at a given moment, a suction head 4 is provided, which is illustrated only schematically and which in a manner known per se can be periodically connected to a vacuum source (not shown in detail). The suction head 4 is moved by means of a drive mechanism 5 along a closed pear-shaped orbit 6. At a pick-up point 7, which is situated at the tip of the orbit 6, the suction head 4 grips the respectively uppermost printing product 2 in the region of its fold edge 2*a* and lifts the gripped printing product off the stack 1 during the movement along the portion 6*a* of the orbit 6. At the delivery point designated 8 the carried printing product 2 is released by disconnection of the vacuum. The suction head 4 then moves further in the circulation direction U. The released printing product 2 in each case is taken over by a discharge conveyor, as described in greater detail in the previously mentioned U.S. patent application Ser. No. 07/997,886, filed Dec. 29, 1992 entitled PROCESS AND APPARATUS FOR DELIVERING PREFERABLY FOLDED PRINTING PRODUCTS TO A FURTHER PROCESSING POINT.

The construction and the mode of operation of the drive mechanism 5 will be explained more fully below.

Figure 3:
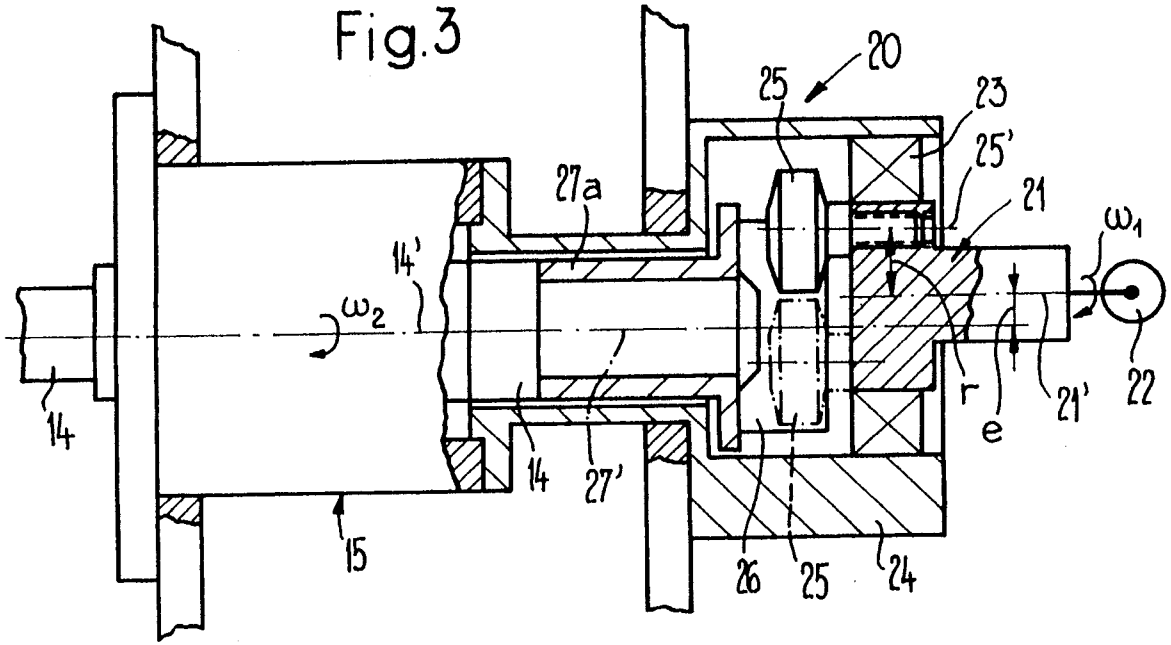
FIG. 3 is a side view, partly in section, of an intermediate transmission unit.

As shown in particular in FIG. 2, the suction head 4 is fastened to a carrier tube 9, which is connected via a hose (not shown) to the previously mentioned vacuum source which can be switched on and off. This carrier tube 9 is fastened on the one arm 10*a* of a two-armed lever 10, the other arm 10*b* of which is bent at an angle to the arm 10*a*. The arm 10*b* forms the connecting rod of a crank-and-rocker linkage 11 and is connected to a crank 13 by means of a joint 12, the joint pin of which is designated 12*a*. Said crank is mounted on a shaft 14, which is rotationally driven in the direction of the arrow A and is rotatably mounted in a bearing 15. The shaft 14, whose longitudinal axis is designated 14', is driven by a drive device which remains to be described with reference to FIGS. 3 and 4. At the other end, the arm 10*b* of the lever 10 is connected by means of a joint 16, whose joint pin is designated 16*a*, to a rocker 17 The latter is fastened on a shaft 18, which is mounted for free rotation in a bearing 19. The longitudinal axis of said shaft 18 is designated 18'. When the crank 13 rotates, the rocker 17 is swivelled to and fro between two end positions, which are shown in dot-dash lines in FIG. 1 and which enclose an angle. The two end positions of the rocker 17 are indicated by the positions, designated 16*a*' and 16*a*'', of the joint pin 16*a*. The positions of the joint pin 12*a* which correspond to these end positions 16*a*' and 16*a*'' are designated 12*a*' and 12*a*''.

By means of the lever drive mechanism 5 described the suction head 4 is now, as previously mentioned, moved from the pick-up point 7 along the portion 6*a* of the orbit 6, upwards to the delivery point 8. Between the pick-up point 7 and the delivery point 8 the suction head 4 is, as previously mentioned, connected to the vacuum source and carries with it in each case the uppermost printing product 2 from the stack 1. After the vacuum source has been disconnected and the printing product 2 carried along has thus been released, the suction head 4 is moved further along the orbit 6 in the direction of the arrow U, until it once again reaches the pick-up point 7, where the next printing product 2 is gripped.

For the suction head 4 to be moved along the desired path 6, the drive mechanism 5 must be appropriately designed. Through this special design of the drive mechanism 5 the pattern of the speed at which the suction head 4 moves along the movement path 6 is also determined. In order now to be able to control this speed pattern determined by the design of the drive mechanism 5, the latter is preceded by an intermediate or superimposition transmission unit 20, which will now be explained more fully with reference to FIGS. 3 and 4.

This intermediate transmission unit 20, in the present case in the form of a crank mechanism, and in particular of a rotating slider crank, comprises a drive member 21 which is driven by a drive motor 22, illustrated only schematically, at a constant speed of rotation, that is to say at a constant angular velocity $\omega_1$. The drive member 21 is mounted by means of a bearing 23 in a casing 24 for rotation about its axis 21'. A driver 25, which in the present exemplary embodiment is a roller is fastened in the drive member 21, for example by means of a screw connection. The longitudinal axis 25' of the driver 25 extends parallel to the axis of rotation 21' of the drive member 21, and relative to the latter is offset by the distance r. In other words, the driver 25 is disposed eccentrically.

The driver 25 is guided in a transverse groove 26 formed in a driven member 27' Said driven member 27 is mounted by a connecting part 27*a* on the shaft 14 of the drive mechanism 5. The axis of rotation 27' of the driven member 27 is thus in line with the axis of rotation 14' of the shaft 14, but is offset by the distance e relative to the axis of rotation 21' of the drive member 21.

Figure 5:
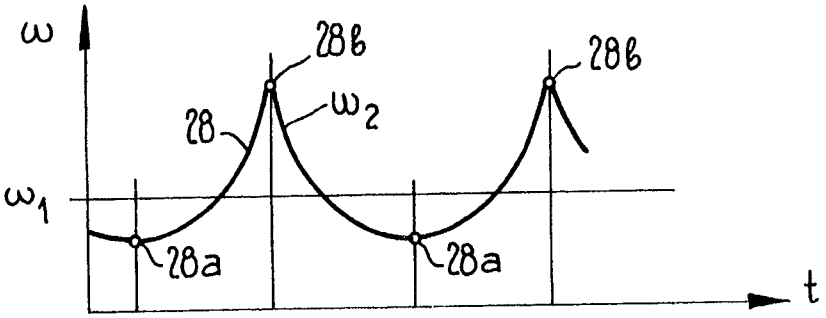
FIG. 5 is a speed/time diagram.
Figure 4:
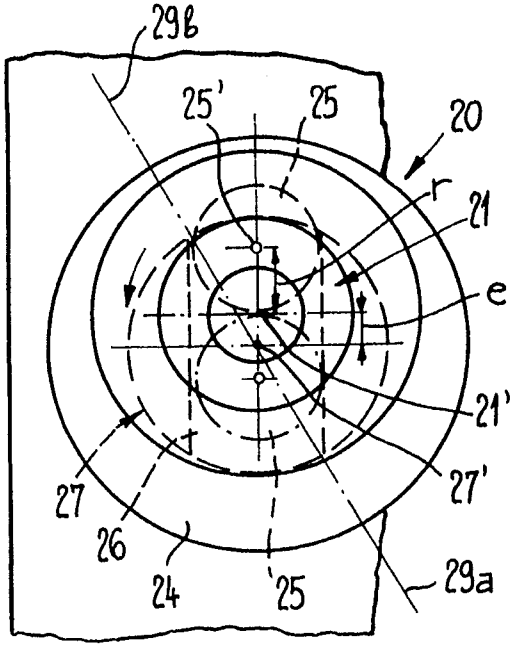
FIG. 4 is a view, taken from its drive side, of the intermediate transmission unit shown in FIG. 3.

The intermediate transmission unit 20, which, as mentioned, is in the form of a rotating slider crank, now converts the constant driving speed of the motor 22 into a periodically varying driving speed for the drive mechanism 5. In FIG. 5 the curve 28 shows the pattern of the angular velocity $\omega$ plotted against time t. While the angular velocity $\omega_1$ at the input of the intermediate transmission unit 20 is constant, the angular velocity $\omega_2$, at which the shaft 14 of the drive mechanism 5 is driven, varies between a minimum value 28*a* and a maximum value 28*b*. In FIG. 4 the references 29*a* and 29*b* indicate the positions of the intermediate transmission unit 20 in which the minimum (position 29*a*) and the maximum (position 29*b*) of the angular velocity $\omega_2$ occur. It is obvious that the positions 29*a*, 29*b* can be selected to lie in any desired locations.

The minimum angular velocity $\int_2$ is obtained from the formula $\omega_2 = r/r + e\ x\omega_1$, while the maximum angular velocity $\omega_2$ is obtained from the formula $\omega_2 = r/r - e\ x\ \omega_1$.

The speed pattern produced, as described, by the intermediate transmission unit 20 is thus superimposed on the speed pattern determined by the design of the drive mechanism 5. This superimposition of speed is effected in such a manner that the speed of movement of the suction held 4 is minimal in the region of the pick-up point 7, that is to save during the lifting of a printing product 2 immediately after it has been gripped, and then increases. Faultless gripping of the printing product respectively uppermost in the stack 1 is thereby ensured, on the one hand, while on the other hand, as the gripped printing product 2 is lifted off the next printing product 2 is prevented from being carried off with it through the action of suction.

Figure 6:
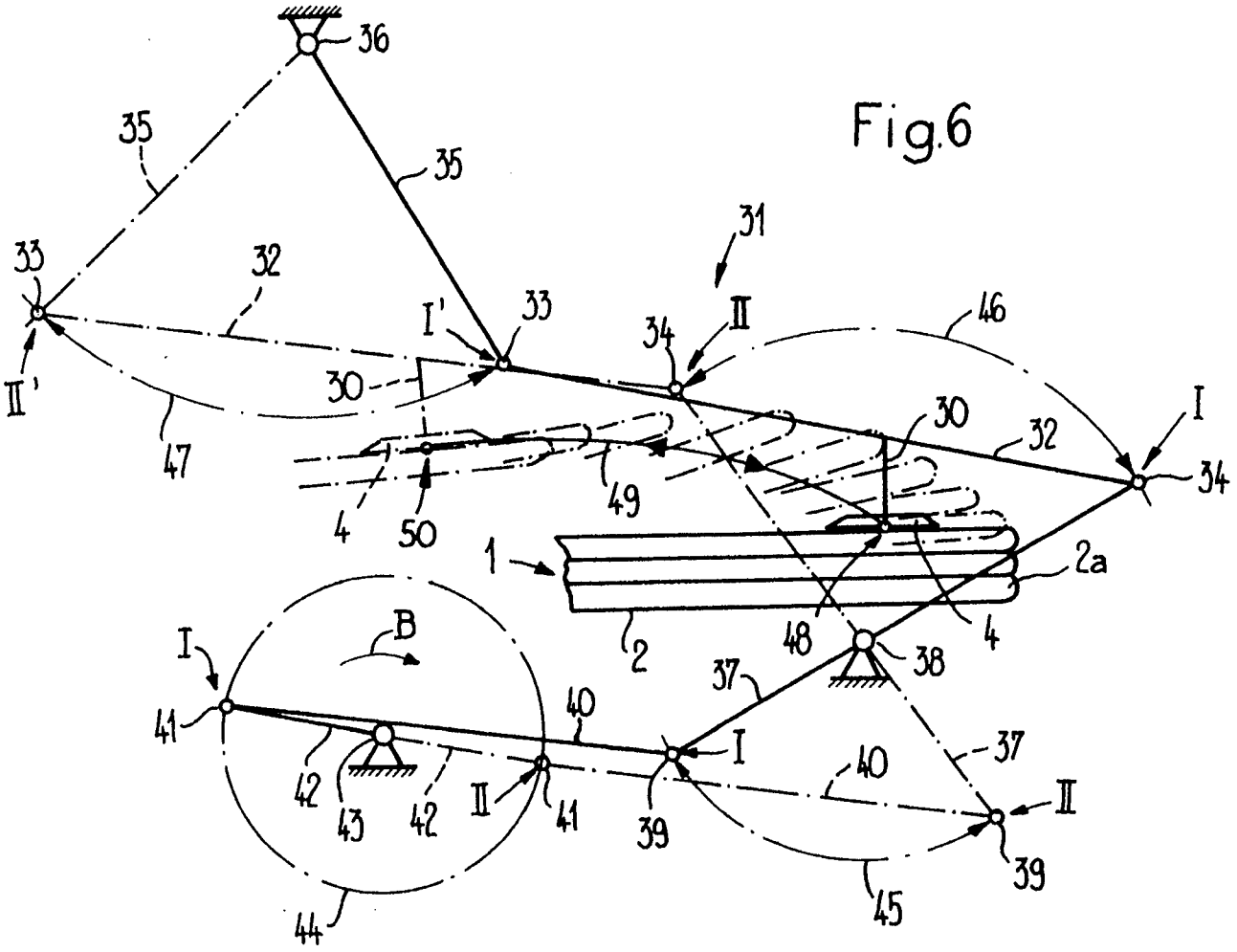
FIG. 6 illustrates in a simplified fashion a second embodiment of an apparatus for lifting printing products off a stack, the drive mechanism being shown entirely schematically.

With reference to the very schematic illustration in FIG. 6 another embodiment of an apparatus for lifting the printing products 2 off the stack 1 will now be described, this embodiment differing from that shown in FIGS. 1 and 2 by a different design of the drive mechanism for the suction head 4.

The suction head 4 is likewise fastened to a carrier tube 30, which is indicated only schematically and which, as described with reference to FIGS. 1 and 2, is connected by a hose (not shown) to a vacuum source. This carrier tube 30 is connected to a drive mechanism 31, which has a lever 32 to which the carrier tube 30 is fastened. At both ends this lever 32 is connected via joints 33 and 34 to other levers. By means of the joint 33 the lever 32 is connected to a lever 35, which is swivellably mounted in a bearing 36. By means of the other joint 34 the lever 32 is connected to a two-armed lever 37, which is swivellably mounted in a bearing 38. At the other end the two-armed lever 37 is connected via another joint 39 to the connecting rod 40 of a crank drive connected via a joint 41 to a crank 42. The latter is mounted on a shaft 43, which is shown only schematically and which is connected to the driven member 27 of the intermediate transmission unit 20. The crank 42 thus turns at the angular velocity $\omega_2$, the pattern of which is shown in FIG. 5, in the direction of the arrow B.

The connecting joint 41 between the crank 42 and the connecting rod 40 accordingly turns along a circular path 44. At the same time the lever 37 makes a swivelling movement about the axis of its bearing 38. The two end positions of the lever 37 are shown in the one case by a solid line and in the other case by a dot-dash line. The two joints 34 and 39 of the lever 37 thus move to and fro along the paths 45 and 46 between the points I and II. The lever 35 swings from the position shown as a solid line into the position shown by a dot-dash line, and back again, while the joint 33 moves to and fro along the path 47 between the points I' and II'.This swinging movement of the levers 37 and 35 also brings about the movement of the lever 32 on which, as mentioned, the carrier tube 30 of the suction head 4 is firmly fastened. The suction head 4 is thereby moved from a pickup point 48 along the slightly curved movement path 49 to a delivery point 50 and, on the same path 49, back again to the pick-up point 48. At the pick-up point 48 the suction head 4, which is now connected to the vacuum source, grips the printing product 2 respectively at the top of the stack 1 and carries it along to the delivery point 50 at which, through the disconnection of the vacuum source, the printing product 2 carried along is released. At this delivery point 50 the printing product 2 released from the suction head 4 is taken over by a discharge conveyor, as described in greater detail in the previously mentioned U.S. patent application Ser. No. 07/997,886, filed Dec. 29, 1992 entitled PROCESS AND APPARATUS FOR DELIVERING PREFERABLY FOLDED PRINTING PRODUCTS TO A FURTHER PROCESSING POINT.

In the embodiment according to FIG. 6, as described with reference to FIGS. 1 to 5 the varying driving speed of the intermediate transmission unit 20 is also superimposed on the speed of movement of the suction head 4 due to the drive mechanism 31, so that in the region of the pick-up point 48 the speed of movement of the suction head 4 is minimal during the lifting of a printing product 2 immediately after it has been gripped, and then increases.

With the same intermediate transmission unit 8 the desired speed pattern can thus be achieved for the suction head 4 with drive mechanisms 5, 31 of different design.

It is also possible to drive the intermediate transmission unit 20 from the other side, that is to say from the member 27. The latter then becomes the drive member coupled to the motor 22, while the drive shaft 43 of the drive mechanism 5, 31 is connected to the member 21 now acting as driven member.

Instead of the combination of a constant speed drive motor 22 with an intermediate or superimposition transmission unit 20, it is also possible to use a variable-speed drive motor, which can then be coupled direct to the shaft 14 or 43 of the drive mechanism 5 or 31.

The solution according to the invention can also be used in embodiments in which the printing products are not lifted off the stack from above, as described above, but are pulled off from the bottom, as described for example in DE-C-27 32 591 and the corresponding U.S. Pat. No. 4,127,262.

I claim:

1. An apparatus for lifting printing products off a stack, comprising: at least one suction head, periodically connectable to a vacuum source, for gripping and carrying along one product at a time, and a drive mechanism coupled to a drive motor for the suction head for moving the latter along a movement path from a pick-up point at which the suction head grips one product at a time, to a delivery point at which the suction head releases the gripped product, and back again, characterized in that the drive motor has a rotary driven output member and is coupled to the drive mechanism via an intermediate transmission unit, said drive mechanism having a rotatably driven input member and said intermediate transmission unit having a rotatably driven input member rotatably connected to the output member of the drive motor and having a rotably driven output member rotatably connected to the rotatably driven input member of the drive mechanism as to convert the speed of rotation ($\omega_1$) of the drive motor into a varying input driving speed ($\omega_2$) for the drive mechanism in order to move the suction head along its path of movement at a varying speed determined other than by the drive mechanism alone.

2. Apparatus according to claim 1, characterized in that the intermediate transmission unit includes a crank mechanism.

3. Apparatus according to claim 1, characterized in that the intermediate transmission unit is in the form of a rotating slider crank.

4. Apparatus according to claim 1, characterized in that the rotatably driven input member of said intermediate transmission unit which is coupled to the drive motor rotary driven output member, has disposed on it a driver which is eccentric to its axis of rotation, and is mounted and engages in a groove in said rotatably mounted driven output member of said transmission unit whose axis of rotation is offset relative to that of the transmission unit input drive member and which is connected to the rotatably driven input member of the drive mechanism.

5. Apparatus according to claim 1, characterized in that the rotatably driven output member of said intermediate transmission unit which is connected to the rotatably driven input member of the drive mechanism has disposed on it a driver which is eccentric to its axis of rotation, and is mounted and engages in a groove in the rotary driven input member of the intermediate transmission unit which is coupled to the drive motor rotary driven output member and whose axis of rotation is offset relative to that of the rotatably driven output member of said intermediate transmission unit.

6. Apparatus according to claim 1, characterized in that the drive mechanism is in the form of a lever mechanism.

7. Apparatus according to claim 6, characterized in that the drive mechanism moving the suction head along a closed path in a direction (U) has a crank-and-rocker linkage with a connecting rod having an extension arm on on which the suction head is mounted.

8. Apparatus according to claim 6, characterized in that the drive mechanism moving the suction head to and fro between two positions along substantially the same path has a lever on which the suction head is fastened and which is connected pivotally at one end to a swivellably mounted oscillating lever and at the other end to another likewise swivellably mounted lever which is coupled to a crank drive driving said lever to swing to and fro.

9. Apparatus according to claim 1, wherein the drive motor has a constant speed of rotation.

10. An apparatus for lifting as defined in claim 1 wherein the drive mechanism and the intermediate transmission together have a speed characteristic which moves the suction head along the path of movement at speeds which in the region of the pick-up point are minimal in relation to the speeds at other points along the path of movement.

11. (Amended) A method for lifting printing products off a stack, in which at least one suction head periodically connectable to a vacuum source is moved by means of a drive mechanism (5,31), which is coupled to a drive motor having a rotatably driven output member, along a movement path from a pick-up point, at which one product at a time is gripped, to a delivery point at which the gripped product is released, and back again, characterized in that said drive mechanism has a rotatably driven input member and the speed of rotation ($\omega_1$) of the drive motor is converted by an intermediate transmission unit (20) having a rotatably driven input member rotatably connected to the output member of the drive motor and having a rotatably driven output member rotatably connected to the rotatably driven input member of the drive mechanism, said intermediate transmission unit being arranged between the drive motor and the drive mechanism (5,31) and having a speed varying characteristic superimposed on the speed of rotation of the drive motor into a varying input driving speed ($\omega_2$) for the drive mechanism in order to move the suction head along its path of movement at a varying speed determined other than by the drive mechanism alone.

12. A method as in claim 11, wherein the drive motor has a constant speed of rotation.

13. A method for lifting as defined in claim 11 wherein the drive mechanism and the intermediate transmission cooperate to move the suction head along the path of movement at a speed which in the region of the pick-up point is minimal in relation to the speeds at other points along the movement path.

* * * * *